US010055953B2

(12) United States Patent
Choi et al.

(10) Patent No.: US 10,055,953 B2
(45) Date of Patent: Aug. 21, 2018

(54) DEVICE FOR ELECTRONICALLY SEALING CONTAINER USING PROXIMITY WIRELESS COMMUNICATION, AND SYSTEM AND METHOD FOR OPERATING SAME

(71) Applicant: S-WINNUS Co., Ltd., Busan (KR)

(72) Inventors: Hyungrim Choi, Busan (KR); Jaejoong Kim, Busan (KR); Jaekee Lee, Busan (KR); Soongoo Hong, Busan (KR); Chaesoo Kim, Busan (KR); Gwanghoon Kwark, Busan (KR); Gangbae Lee, Busan (KR); Eunkyu Lee, Busan (KR); Jungrock Son, Busan (KR); Sungpill Choi, Busan (KR); Youngsik Moon, Busan (KR); Joongjo Shin, Busan (KR); Jinwook Lee, Busan (KR); Heemok Son, Busan (KR); Yoonji Kim, Gyeongsangnam-do (KR); Minho Kim, Busan (KR); Junwoo Jung, Busan (KR); Hansoo Park, Busan (KR); Minjung Kim, Busan (KR); Jaeseong Oh, Busan (KR); Woocheol Choi, Busan (KR)

(73) Assignee: S-WINNUS CO., LTD., Busan (KR)

( * ) Notice: Subject to any disclaimer, the term of this patent is extended or adjusted under 35 U.S.C. 154(b) by 95 days.

(21) Appl. No.: 14/917,027

(22) PCT Filed: Sep. 24, 2013

(86) PCT No.: PCT/KR2013/008542
§ 371 (c)(1),
(2) Date: Mar. 7, 2016

(87) PCT Pub. No.: WO2015/037771
PCT Pub. Date: Mar. 19, 2015

(65) Prior Publication Data

US 2016/0217665 A1 Jul. 28, 2016

(30) Foreign Application Priority Data

Sep. 16, 2013 (KR) ..... 10-2013-0111331
Sep. 16, 2013 (KR) ..... 10-2013-0111343

(51) Int. Cl.
*G08B 13/00* (2006.01)
*G08B 13/12* (2006.01)
*E05B 39/00* (2006.01)
*E05B 13/00* (2006.01)

(52) U.S. Cl.
CPC ..... *G08B 13/126* (2013.01); *E05B 13/002* (2013.01); *E05B 39/005* (2013.01)

(58) Field of Classification Search
CPC ... G08B 13/126; E05B 13/002; E05B 39/005; E05B 83/14; B65D 90/008; B65D 90/22; G07C 9/00182
(Continued)

(56) References Cited

U.S. PATENT DOCUMENTS 5,615,625 A * 4/1997 Cassidy ..... E05G 1/005 109/24.1
6,057,779 A * 5/2000 Bates ..... G06Q 50/28 340/10.51
(Continued)

FOREIGN PATENT DOCUMENTS

KR 10-2007-0114483 12/2007
KR 10-2010-0007327 1/2010
(Continued)

OTHER PUBLICATIONS

International Search Report dated May 23, 2015 From the Korean Intellectual Property Office Re. Application No. PCT/KR2013/008542.

*Primary Examiner* — Naomi J Small
(74) *Attorney, Agent, or Firm* — Rabin & Berdo, P.C.

(57) ABSTRACT

The objective of the present invention is to provide a device for electronically sealing a container using proximity wireless communication for controlling the sealing of a container door from a remote distance by applying a proximity wireless communication technique to the device for electronically sealing a container, so that unlocking a container becomes more convenient, rapid, and safer, and to provide a system and a method for operating the device for electronically sealing a container. The device for electronically sealing a container is coupled to a keychain outside of the container, so that whether the container door is open or closed can be checked in real time, and various types of information related to the container can be relayed, in real time, to a shipper or persons associated with tracking the container, thereby fundamentally eliminating the possibility of illegal opening and closing of container doors associated with existing container-locking devices, and also allowing convenient, rapid, and safe unlocking of container doors.

17 Claims, 5 Drawing Sheets

(58) Field of Classification Search
USPC ..... 340/541
See application file for complete search history.

(56) References Cited

U.S. PATENT DOCUMENTS 8,907,794 B2 * 12/2014 Estevez ..... E05B 47/0009 340/425.5
2003/0121968 A1 * 7/2003 Miller ..... G07F 17/12 235/375
2003/0179073 A1 * 9/2003 Ghazarian ..... E05B 47/00 340/5.6
2004/0183673 A1 * 9/2004 Nageli ..... G01S 5/0018 340/539.13
2005/0179545 A1 * 8/2005 Bergman ..... G08B 13/08 340/545.2
2006/0010077 A1 * 1/2006 Dohrmann ..... A47G 29/141 705/65
2008/0303631 A1 12/2008 Beckley et al.
2009/0280862 A1 * 11/2009 Loughlin ..... E05B 29/00 455/556.1
2010/0176919 A1 * 7/2010 Myers ..... G07C 9/00571 340/5.73
2010/0328031 A1 * 12/2010 Powers ..... E05B 39/005 340/5.64
2013/0000362 A1 * 1/2013 Bae ..... E05B 39/00 70/57.1

FOREIGN PATENT DOCUMENTS

KR 10-0969594 7/2010
KR 10-2010-0132944 12/2010
KR 10-2011-0023218 3/2011
KR 10-1124961 3/2012
KR 10-1259546 4/2013
WO WO 2015/037771 3/2015

* cited by examiner

DEVICE FOR ELECTRONICALLY SEALING CONTAINER USING PROXIMITY WIRELESS COMMUNICATION, AND SYSTEM AND METHOD FOR OPERATING SAME

RELATED APPLICATIONS

This application is a National Phase of PCT Patent Application No. PCT/KR2013/008542 having International filing date of Sep. 24, 2013, which claims the benefit of priority of Korean Patent Applications Nos. 10-2013-0111331 and 10-2013-0111343, both filed on Sep. 16, 2013. The contents of the above applications are all incorporated by reference as if fully set forth herein in their entirety.

FIELD AND BACKGROUND OF THE INVENTION

The present invention relates to a device for electronically sealing a container and a system and method for operating the same, and in particular to a device for electronically sealing a container and a system and method for operating the same wherein the sealing of a container door can be controlled from a remote distance by applying a proximity wireless communication technique to the device for electronically sealing a container for the sake of a locking and unlocking of the container becomes more convenient, rapid, and safer.

The container used in a freight transportation industry in general is called a freight container in the ISO (International Organization for Standardization) and is called a cargo container in the ANSI (American National Standards Institute). The container is made of various materials, for example, wood, plywood, steel, aluminum, light alloy, FRP (Fiber Reinforced Plastic), etc. The above container may be classified based on its use purpose into a dry cargo container, a heat keeping container, a bulk container, a high cube container, a reefer container, an open top container, a ventilated container, a flat rack container, a livestock container, a cold keeping container, a house container, a high container, an oxide container, a car container, etc.

In a freight transportation industry using such containers, a freight safety is considered the most safety matter in addition to the transportation of the freight. The current container designing is not providing any mechanism to monitor the container itself and the safety of the stuff in the container.

In this regard, the freight transportation companies and the customers thereof are trying to develop a predetermined means to continuously check and monitor the transportation state of the shipped containers and the safe transportation of the freight, and the related government authority is also trying to develop various prevention means to prevent the carry-in of any inhibited or harmful substances, for example, a drug, a mass destruction weapon, etc. hid in the container. That is, the freight transportation company and the government authority are using one or more door hasp mechanism, more specifically, a safety device, for example, a lock, a plastic and metallic roof sealing and a cable sealing, a bolt sealing, etc. in an effort to prevent any unauthorized approach to the transportation container.

But, the above described freight transportation using the container may take months in terms of a transportation period via multiple stages, for example, a freight loading, a transportation using a truck, a gate-in, a shipping, a sailing, a disembark, a gate-out, a transportation using a truck, a freight unloading, etc. Even though the door is sealed using the above mentioned door hash mechanism, the door hash mechanism may be broken during the transportation procedure, which may result in the robbery of the freight. The worse problem is that no one can easily recognize such robbery.

In an effort to prevent such a situation, the customer, the freight transportation company and the government authority are monitoring the security and state of the container in such a way to install at the container a safety tag and a memory button or an electronic sealing, by means of which a corresponding transportation container can be traced.

In case of the above mentioned electronic sealing, it is equipped with only a function to inform the user when the container door is open. For this reason, any illegal opening possibility of the container door cannot be substantially resolved.

SUMMARY OF THE INVENTION

Accordingly, the present invention is made in an effort to resolve the above problems. It is an object of the present invention to provide an device for electronically sealing a container and a system and method for operating the same which are able to control from a remote distance by applying a proximity wireless communication technique to the device for electronically sealing a container for the sake of becomes more convenient, rapid, and safer unlocking of the container.

Other objects of the present invention are not limited to the above-mentioned object, and other objects not mentioned herein may be clearly understood by a person having ordinary skill in the art from the following recitations.

To achieve the above object, there is provided an device for electronically sealing a container using proximity wireless communication, which may include, but is not limited to, a main body unit which includes a driving control unit disposed inside thereof and is installed detachable at a container main body wall surface and a container door; and a locking unit which is able to unlock the container door in accordance with a control signal of the driving control unit provided inside of the main body unit, wherein the driving control unit which may include, but is not limited to, a mobile communication unit which is able to communication with a server located outside; a GPS (Global Positioning System) which is provided to locate the current position of a container electronic sealing device; a storing unit which is able to store an internal information of the container and an ID (Identification) of a NFC (Near Field Communication) tag; a sealing detection sensor unit which is able to check if the container door has been illegally opened; a NFC unit which is provided to control the sealing by unlocking the container door by employing a NFC (Near Field Communication) method; and a setting processing unit which is provided to control an operation wherein a transmission data checked by the sealing detection sensor unit is transmitted to a server or a user terminal at a cycle set by a user, and if an illegal opening and closing and a deviation at a set path occur, an event data is transmitted in real time to the server or the user terminal.

Preferably, the driving control unit further comprises a container internal and external detection sensor unit which is provided to sense a surrounding information inside and outside of the container door which is formed of one or more than one selected among a temperature, a humidity, a position, a sealing, an impact, and a luminance.

Preferably, the ID of the NFC tag is an ID which is used to break the sealing of the container door and can be received in such a way to transmit a request data (Init Packet) including a dedicated ID of the container electronic sealing device to a server via a mobile communication unit.

Preferably, the storing unit is able to store a request data (Init Packet) information on a request to the server after the sealing of the container electronic sealing device is broken, a sealing breaking information, a log on the transmission of information to a user, and an equipment state log.

Preferably, the transmission data includes a sealing breaking state checked by the sealing detection sensor unit, and a surrounding information inside and outside of the container door checked by the container internal and external detection sensor unit.

To achieve the above objects, there is provided a method for electronically sealing a container using proximity wireless communication, which may include, but is not limited to, a step (A) wherein when the sealing of a container electronic sealing device is completed, a request data (Init Packet) including a dedicated ID of the container electronic sealing device which has been previously set and stored as it is connected to an external server via a mobile communication network is transmitted; a step (B) wherein a request response data (Init Ack Packet) is received, which includes an ID of a NFC tag, which is used to break the sealing of the container electronic sealing device based on the dedicated ID of the container electronic sealing device via the server, a data storing cycle, and a data transmission cycle; a step (C) wherein when the request response data (Init Ack Packet) is inputted from the server, an information data (Data Packet) including a sensing information obtained by detecting a surrounding information inside and outside of the container door is transmitted to the server using the mobile communication network at a data storing cycle included in the request response data; a step (D) wherein an information response data (Data Ack Packet) corresponding to the check from the server which receives an information data (Data Packet), and a command data are received from the container electronic sealing device; a step (E) wherein a command response data (Command Ack Packet) is transmitted to the server after a function corresponding to a command data (Command Packet) received from the server is carried out; a step (F) wherein when the container electronic sealing device arrives at a destination, the breaking of the sealing is tried using the NFC tag; and a step (G) wherein when the sealing of the container electronic sealing device is broken, the container electronic sealing device is rebooted.

Preferably, the command data includes a command data (Command Packet) on a server IP, a port change, a data storing cycle change, a data transmission cycle change, a NFC tag ID addition and deletion.

Preferably, the sending information on the surrounding information sensed in the step (C) includes a temperature, a humidity, a position, a sealing, an impact, and a luminance, and the sensing information has a previously set threshold value, and if the value is out of a regional range of the set threshold value, an event data is transmitted in real time to a server or a user terminal.

Preferably, in the step (E), an estimated movement path of the container electronic sealing device is received from the server, and if the received path is out of a corresponding region or if the illegal opening of the container door occurs, an alarm is transferred in real time to the server or the user terminal.

Preferably, in the step (F), if there is not any NFC tag that the container electronic sealing device can break with the sealing, a predetermined GPS value can be inputted, and it can be opened at a corresponding region.

Preferably, wherein in the step (F), if the container electronic sealing device does not arrive at a desired destination within a predetermined time in a state where an operation time of the container electronic sealing device is inputted, an alarm is transmitted to the server.

Preferably, in the step (G), the storing unit stores a request data (Init Packet) information, a sealing breaking information, a log on the transmission of the information to the user, and an equipment state log.

To achieve the above objects, there is provided a system for operating an device for electronically sealing a container, which may include, but is not limited to, a container electronic sealing device including a main body unit which is installed detachable at a container main body wall surface and container door, and a locking unit provided to unlock the container door in accordance with a control signal of a driving control unit installed inside of the main body unit; and a server which is configured to transmit or receive a data, wherein the server includes an information transmission and receiving interface unit which is configured to transmit and receive information with the container electronic sealing device; an information encoding and decoding unit which is configured to encode and decode a data with respect to the container electronic sealing device via the information transmission and receiving interface unit; an information analyzing unit which is able to analyze the content of the information data received via the information transmission and receiving interface unit; a NFC tag pre-matching unit which is provided to generate a NFC tag ID used to break the sealing of the container electronic sealing device based on a dedicated ID of the container electronic sealing device received from the container electronic sealing device and check the matching state of the NFC tag ID received from the container electronic sealing device when the container electronic sealing device arrives at a destination; a transfer information packet generation unit which is able to generate in the form of a packet the data which is transmitted to the container electronic sealing device; a state setting unit which is configured to set the sealing state of the container electronic sealing device based on a data transmission and reception with the container electronic sealing device; and a manager interface unit which is able to transmit or receive a setting change and a setting change completion information by a manager based on the state setting unit.

Preferably, the number of the IDs of the NFC tag generated by the NFC tag pre-matching unit is multiple, and the sealing-breakable NFC tag ID of the container electronic sealing device, the sealing-breakable NFC tag of which is lost, in a remote area be able to reset at the server if the NFC tag is lost, and can be provided to the mobile communication unit.

To achieve the above objects, there is provided a method for operating an device for electronically sealing a container, which may include, but is not limited to, a step (a) wherein a request data (Init Packet) including a dedicated ID of a container electronic sealing device is transmitted from the container electronic sealing device connected to a server via a mobile communication network; a step (b) wherein a request response data (Init Ack Packet) is transmitted, which includes a data storing cycle and a data transmission cycle together with the ID of a previously matched NFC tag wherein the sealing of the container electronic sealing device can be broken based on an inputted dedicated ID of the container electronic sealing device; a step (c) wherein an information data including a surrounding information sensed by the container electronic sealing device is transmitted using the mobile communication network at a data transmission cycle included in the request response data; a step (d) wherein when an information data (Data Packet) is inputted from the container electronic sealing device, an information response data (Data Ack Packet) to check the reception of the data or a command data (Command Packet) including a server IP/port change, a data storing cycle change, a data transmission cycle change, a NFC tag ID addition and deletion is transmitted to the container electronic sealing device; a step (e) wherein a command response data (Command Ack Packet) is transmitted after the container electronic sealing device carries out a corresponding function based on the command data (Command Packet); a step (f) wherein an estimated movement path is transmitted to the container electronic sealing device, and if a corresponding region is deviated, an alarm is received; a step (g) wherein as the container electronic sealing device arrives at a destination, and a sealing breaking is tried using the NFC tag, the matching state of the NFC tag ID which has been received by receiving the used NFC tag is checked, and when a checking is completed, a sealing breaking setting information for breaking the sealing of the container electronic sealing device is transmitted; and a step (h) wherein when the sealing of the container electronic sealing device is broken, the container electronic sealing device is rebooted.

Preferably, the NFC tag used in the step (g) allows to reset the NFC tag ID which is able to break in real time the sealing in such a way to use a mobile communication when the container electronic sealing device is using based on the step (d).

To achieve the above objects, there is provided a method for operating an device for electronically sealing a container, which may include, but is not limited to, a step wherein when a request data (Init Packet) including a dedicated ID of a container electronic sealing device is received from the container electronic sealing device connected via a mobile communication network, a sealing-breakable NFC tag ID which has been previously matched with the transmitted dedicated ID of the container electronic sealing device is transmitted to the container electronic sealing device; a first check step wherein when an information data (Data Packet) is received from the container electronic sealing device, it is checked what the received information data contains; a step wherein as a result of the first check, if the information data received from the container electronic sealing device is an alarm information, the received alarm information is checked, and the opening of a container door is reported via either SMS or e-mail through a manager and user terminal; a step wherein as a result of the first check, if the information data received from the container electronic sealing device is a sealing breaking information, the current position information and the NFC tag ID of the container electronic sealing device are detected among the received sealing breaking information, thus checking if the container electronic sealing device has arrived at a destination and checking a matching state of the NFC tag ID; a second check step wherein as a result of the first check, if the information data received from the container electronic sealing device is an information on cycles, and if there is a setting change information, it is checked what information of the container electronic sealing device is to be changed; a step wherein as a result of the second check, if it is checked that the setting change information corresponds to a change of a server information, an information transmission server IP and port change information of the container electronic sealing device are transmitted; a step wherein as a result of the second check, if it is checked that the setting change information corresponds to a change of a cycle setting information, a GPS, an information storing, and an information transmission cycle change information of the container electronic sealing device are transmitted; and a step wherein as a result of the second check, if it is checked that the setting change information corresponds to a change of the NFC tag information, a sealing-breakable NFC tag ID change (an addition and a deletion) information of the container electronic sealing device is transmitted.

Preferably, there is further provided a step wherein if the information data has been checked in the first check step, an information response data is transferred to check a normal reception of the information data received from the container electronic sealing device.

Preferably, there is further provided a step wherein a setting change completion information corresponding to a setting change information transmitted from the container electronic sealing device is received after the setting change information is transmitted to the container electronic sealing device in the second check step.

Preferably, there is further provided a step wherein an information normal reception check response data transmitted from the container electronic sealing device is transferred again to the container electronic sealing device if the change completion information is received as a result of the second check.

The device for electronically sealing a container using proximity wireless communication method and a system and method for operating the same according to the present invention may have the following advantageous effects.

First, the product of the present invention can be coupled to a keychain outside of the container, so that whether the container door is open or closed can be checked in real time, and various types of information related to the container can be relayed, in real time, to a shipper or persons associated with tracking the container.

Second, since only the authorized person is allowed to open the container door, a safe freight transportation is available, and it is possible to take an appropriate measure if the NFC tag used for an identification is lost.

Third, the present invention is able to fundamentally eliminating the possibility of illegal opening and closing of container doors associated with existing container-locking devices, and also allowing convenient, rapid, and safe unlocking of container doors.

DESCRIPTION OF SPECIFIC EMBODIMENTS OF THE INVENTION

Figure 1:
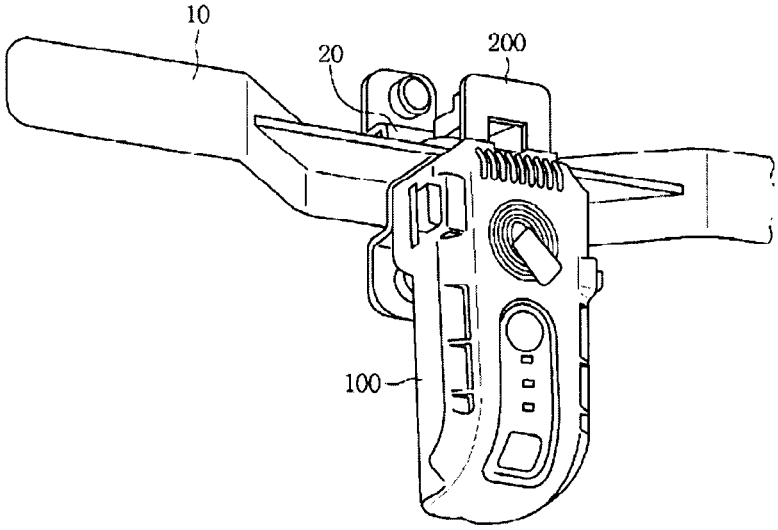
FIGS. 1 and 2 are views illustrating a configuration of a device for electronically sealing a container using proximity wireless communication method according to an embodiment of the present invention.

The other objects, characteristics and advantages of the present invention will become clear through the descriptions of the embodiments with reference to the accompanying drawings.

The device and method for electrically sealing a container using a proximity wireless communication according to the present invention will be described with reference to the accompanying drawings. It is noted that the present invention is not limited to the embodiments to be recited below, and may be carried in various forms, and the present embodiments are provided to inform a person having ordinary skill in the art of the scope of the present invention, whereupon the embodiments recited in the present specification and the configuration illustrated in the drawings are provided only as the most preferred embodiments of the present invention, not representing all the technical concepts of the present invention, and various equivalents and modification may exit, which could substitute them at the time of the application of the present invention.

Figure 2:
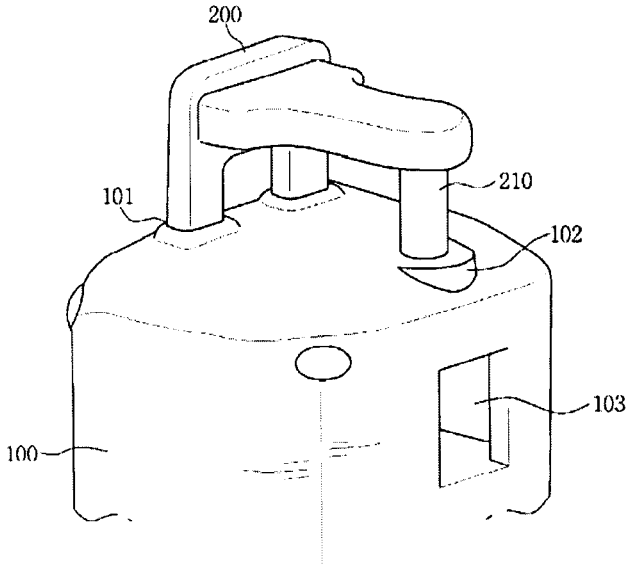

FIGS. 1 and 2 are views illustrating a configuration of a device for electronically sealing a container using proximity wireless communication method according to an embodiment of the present invention.

As illustrated in FIGS. 1 and 2, the device for electronically sealing a container using proximity wireless communication may include, but is not limited to, a main body unit 100 which is engaged detachable to an engaged portion 10 (hereinafter referred to "a container door") between a container main body wall surface and a container door; and a locking unit 200 which is configured to unlock the container door 10 in accordance with a control signal of a driving control unit provided in the inside of the main body unit 100.

The main body unit 100 is configured in such a way that a driving control unit is provided inside thereof, and it is formed in a structure wherein a guide hole 101 and a locking hole 102 are formed, passing through, at the top thereof in order for the locking unit 200 to move upward or downward. At a rear surface of the main body unit 100, a drainage hole 103 is formed passing through in the direction of the outside of the main body unit 100 in order for the water which is inputted into the inside of the locking hole 102 to directly discharge to the outside of the main body unit 100, not gathering in the inside of the locking hole 102, since the drainage hole 103 is formed communicating with a lower end portion of the locking hole 102. The above inner control unit will be described in detail below.

The locking unit 200 is formed in a bar type of an inverted U-shape. If the locking unit 200 is formed in a shape wherein the left and right widths are long, the locking unit 200 is not easy to cut, thus providing an advantage to prevent robbery. An upper end portion of the locking unit 200 is bent at a right angle and is formed horizontal to the ground, and a locking bar 210 is formed at an end portion thereof, wherein the locking bar 210 is inserted in a sealing hole of a mechanical seal 20 of the container door while coming in and going out of the locking hole 102 of the main body unit 100. The locking bar 210 may have a roughly circular cross section and is formed extending downward by a predetermined length from an upper end portion of the locking unit 200.

Figure 3:
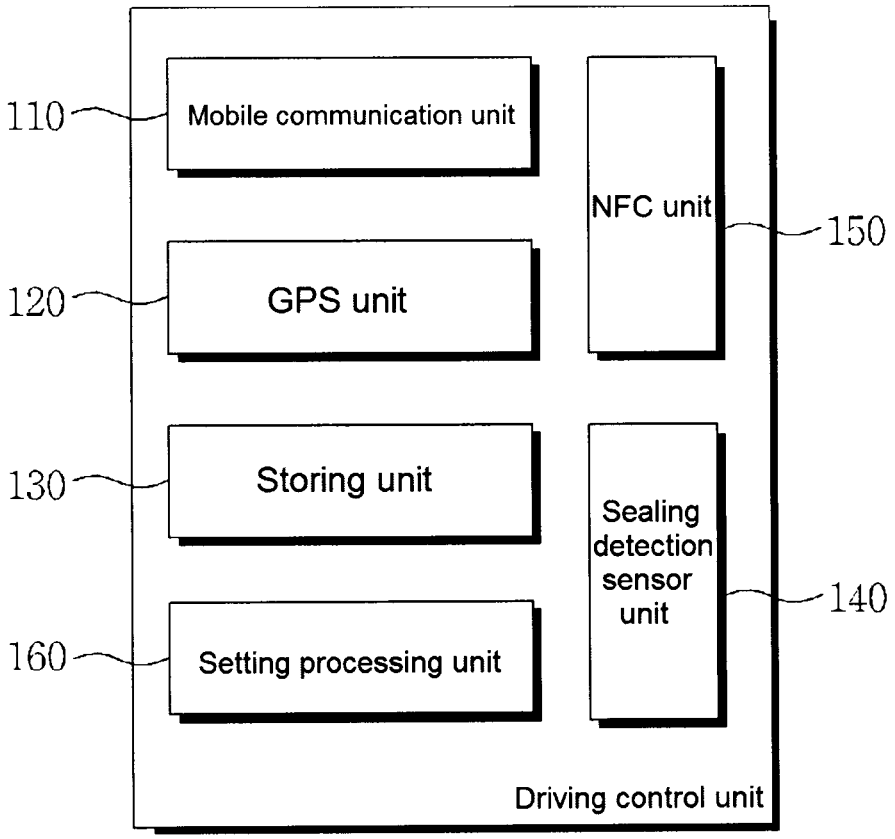
FIG. 3 is a block diagram illustrating a configuration of a driving control unit provided in the inside of a main body unit in FIG. 1.

FIG. 3 is a block diagram illustrating a configuration of the driving control unit disposed in the inside of the main body unit in FIG. 1.

As illustrated in FIG. 3, the driving control unit may include, but is not limited to, a mobile communication unit 110 which is able to communicate with a server 300 located outside, a GPS unit 120 which is able to locate the current position of a container electronic sealing device, a storing unit 130 which is configured to store an internal information of the container and the ID of the NFC tag, a sealing detection sensor unit 140 which is provided to check if the container door has been illegally opened, a NFC unit 150 which is able to control the sealing in such a way to unlock the container door by employing the near field communication (NFC) method, and a setting processing unit 160 which is provided to control an operation wherein a transmission data (a state on if the sealing is broken or not, and a GPS information, etc.) checked by the sealing detection sensor unit 140 is transmitted to a server or a user terminal at a cycle set by a user, and if an illegal opening and closing and a deviation at a set path occur, an event data is transmitted in real time to the server or the user terminal.

At this time, the ID of the NFC tag is an ID which will be used to break the sealing of the container door and can be received in such a way to transmit a request data (Init Packet) including a dedicated ID of the container electronic sealing device to a server via a mobile communication unit 110. Here, the number of the IDs of the NFC tag which is provided from the server 300 may be multiple, and the ID of the NFC tag can be set again, which is able to break in real time the sealing by using the mobile communication unit 110 via the server if the NFC tag is lost.

The storing unit 130 is able to store a request information (Init Packet) which is requested to the server 300 after the sealing of the container electronic sealing device is broken, a sealing breaking information, a log on the information transmitted to the user, an equipment state log, etc. The stored information will be used so as to check the reason for error if the error occurs in the future time.

In addition, the transmission data may include an information on if the sealing is broken or not, which may be checked by the sealing detection sensor 140, and a surrounding information (a temperature, a humidity, a position, a sealing, an impact, a luminance, etc.) inside and outside of the container door which can be checked by the detection sensor unit (not illustrated) inside and outside of the container.

Figure 4:
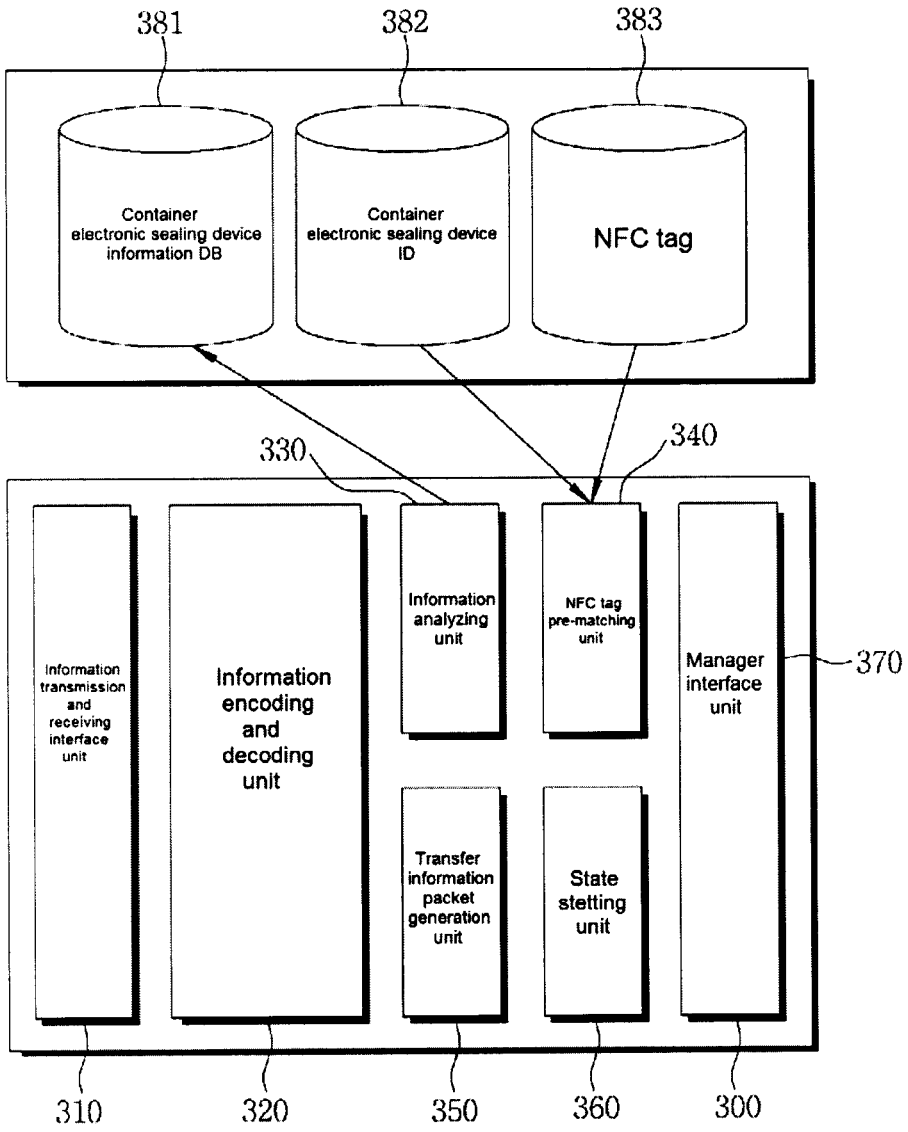
FIG. 4 is a block diagram illustrating a configuration of a system which is employed to operate a device for electronically sealing a container which is installed at a server to carry out a wireless communication with a driving control unit in FIG. 1.

FIG. 4 is a block diagram illustrating a configuration of a system which is able to operate the device for electronically sealing a container which is built via a wireless communication with the driving control unit in FIG. 1.

As illustrated in FIG. 4, the system which is configured to operate the device for electronically sealing a controller which is built at the server 300 may include, but is not limited to, an information transmission and receiving interface unit 310 which is able to transmit or receive the information from the container electronic sealing device 100, an information encoding and decoding unit 320 which is provided to encode or decode the data with the container electronic sealing device 100 via the information transmission and receiving interface unit 310, an information analyzing unit 330 which is provided to analyze the contents of the data received via an information transmission and receiving interface unit 310, a NFC tag pre-matching unit 340 wherein a NFC tag ID which is generated and is able to break the sealing of the container electronic sealing device 100, based on a dedicated ID of the container electronic sealing device 100, received from the container electronic sealing device 100, and when the container electronic sealing device 100 arrives at a destination, the matching state of the NFC tag ID from the container electronic sealing device 100 is checked, a transfer information packet generation unit 350 which is able to generate in the form of a packet the data which will be transmitted to the container electronic sealing device 100, a state setting unit 360 which is provided to set a sealing state of the container electronic sealing device 100, which is based on a data transmission and reception with the container electronic sealing device 100, and a manager interface unit 370 which is provided to transmit or receive a setting change information and a setting change completion information by the manager based on the state setting unit 360. A storing unit 380 is further provided, which is able to store an information and dedicated ID of the container electronic sealing device 100 and a NFC tag information set for breaking the sealing.

At this time, the ID of the NFC tag is an ID which is used to break the sealing of the container door and is transmitted in the form of a response request data corresponding to a request data (Init Packet) received from the container electronic sealing device 100 via the mobile communication unit.

Moreover, the number of the IDs of the NFC tag generated by the NFC tag pre-matching unit 340 may be multiple, and the sealing-breakable NFC tag ID of the container electronic sealing device 100, the sealing-breakable NFC tag of which was lost, in a remote area be able to reset at the server 300 if the NFC tag is lost, and can be provided to a mobile communication unit.

The operation of the system which is able to operate the device for electronically sealing a control according to the present invention will be described with reference to the accompanying drawings. The same reference numbers in FIGS. 1, 2, 3, and 4 represent the same components having the same functions.

Figure 5:
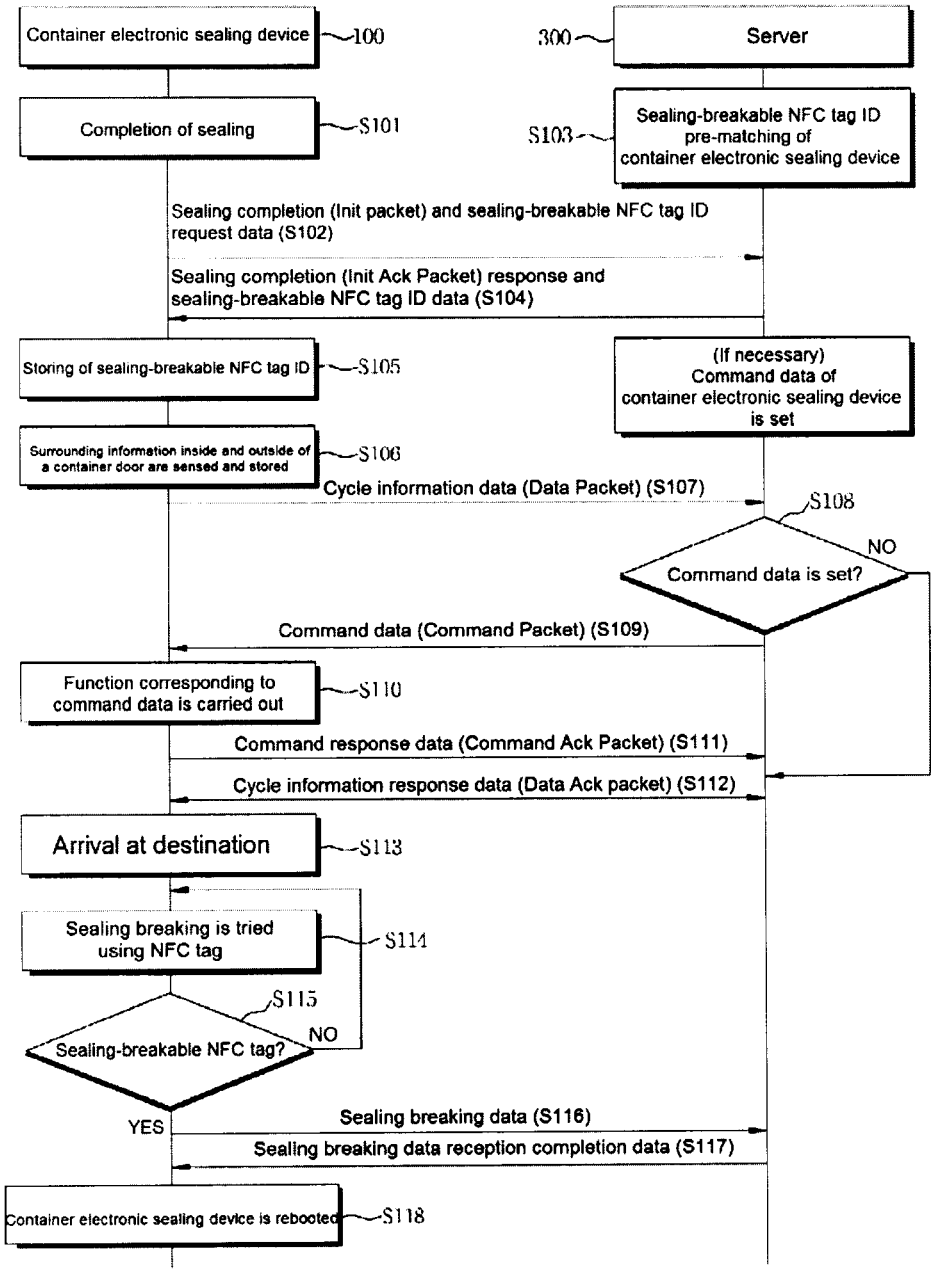
FIGS. 5 and 6 are flow charts for describing a method which is employed to operate a device for electronically sealing a container according an embodiment of the present invention.

FIG. 5 is a flow chart for describing the method provided to operate the device for electronically sealing a container according to an embodiment of the present invention.

Referring to FIG. 5, if the sealing of the container electronic sealing device 100 is normally completed (S101), and a connection to the server 300 is made via a mobile communication network, a request data (Init Packet) including a dedicated ID of the container electronic sealing device 100 is transmitted from the container electronic sealing device 100 (S102).

As the dedicated ID of the container electronic sealing device 100 is inputted, the server 300 will generate a NFC tag ID which is able to break the sealing of the container electronic sealing device 100 via the NFC tag pre-matching unit 340 (S103), and a request response data (Init Ack Packet) including a data storing cycle, a data transmission cycle, etc. is transmitted together with the generated NFC tag ID (S104).

The container electronic sealing device 100 will store the sealing-breakable NFC tag ID included in the request response data (Init Ack Packet) transmitted from the server 300 (S105) and will continuously detect and store the surrounding information (a temperature, a humidity, a position, a sealing, an impact, a luminance, etc.) inside and outside of the container door (S106). And the container electronic sealing device 100 will transmit all the information data including a stored collection information to the server 300 by using a mobile communication network at every data transmission cycle (S107).

When the information data (Data Packet) is received from the container electronic sealing device 100, the server 300 will transmit an information response data (Data Ack Packet) which is corresponding to an acknowledgment, to the container electronic sealing device 100 (S111).

At this time, the server 300 will check if a command data with respect to the container electronic sealing device 100 has been set (S108), and will transmit to the container electronic sealing device 100 a command data (Command Packet) which is related with a server IP/Port change, a data storing cycle change, a data transmission cycle change, a NFC tag ID addition and deletion (S109). Moreover, when a command data (Command Packet) is received from the server 300, the container electronic sealing device 100 will carry out a function corresponding thereto (S110) and will transmit a command response data (Command Ack Packet) to the server 300 (S111), and the server 300 will transmit an information response data (Data Ack Packet) with respect to the information data (Data Packet) received from the container electronic sealing device 100 (S112). In addition, the server 300 may receive an alarm if a corresponding region is deviated in such a way to transmit an estimated movement path of the container electronic sealing device 100.

When the container electronic sealing device 100 has arrived at the destination (S113), the sealing will be broken using the NFC tag (S114). Here, the number of the IDs of NFC tag which are used to break the sealing of the container electronic sealing device 100 may be multiple, and if the NFC tag is lost, the server 300 may reset in real time the ID of the NFC tag, which is able to break the sealing, via a mobile communication (S115). If there is not any NFC tag that the container electronic sealing device can break with the sealing, the system may be set for the same to be opened at a corresponding region after a predetermined GPS value has been inputted. If it does not arrive at a desired destination within a specific time after a predetermined time of the container electronic sealing device is inputted, the server will receive an alarm.

When the container electronic sealing device breaks the sealing, the container electronic sealing device 100 will transmit a sealing breaking data to the server 300 (S116), and the server 300 will transmit a sealing breaking data reception completion data to the container electronic sealing device 100 (S117).

Thereafter, the container electronic sealing device 100 is rebooted (S118). Since the storing unit 130 of the EEPROM is storing a request data (Init Packet) information, a sealing breaking information, a log on the transmission of information to the user, and an equipment state log, etc., it may be possible to know what was a problem by checking it in the future.

Figure 6:
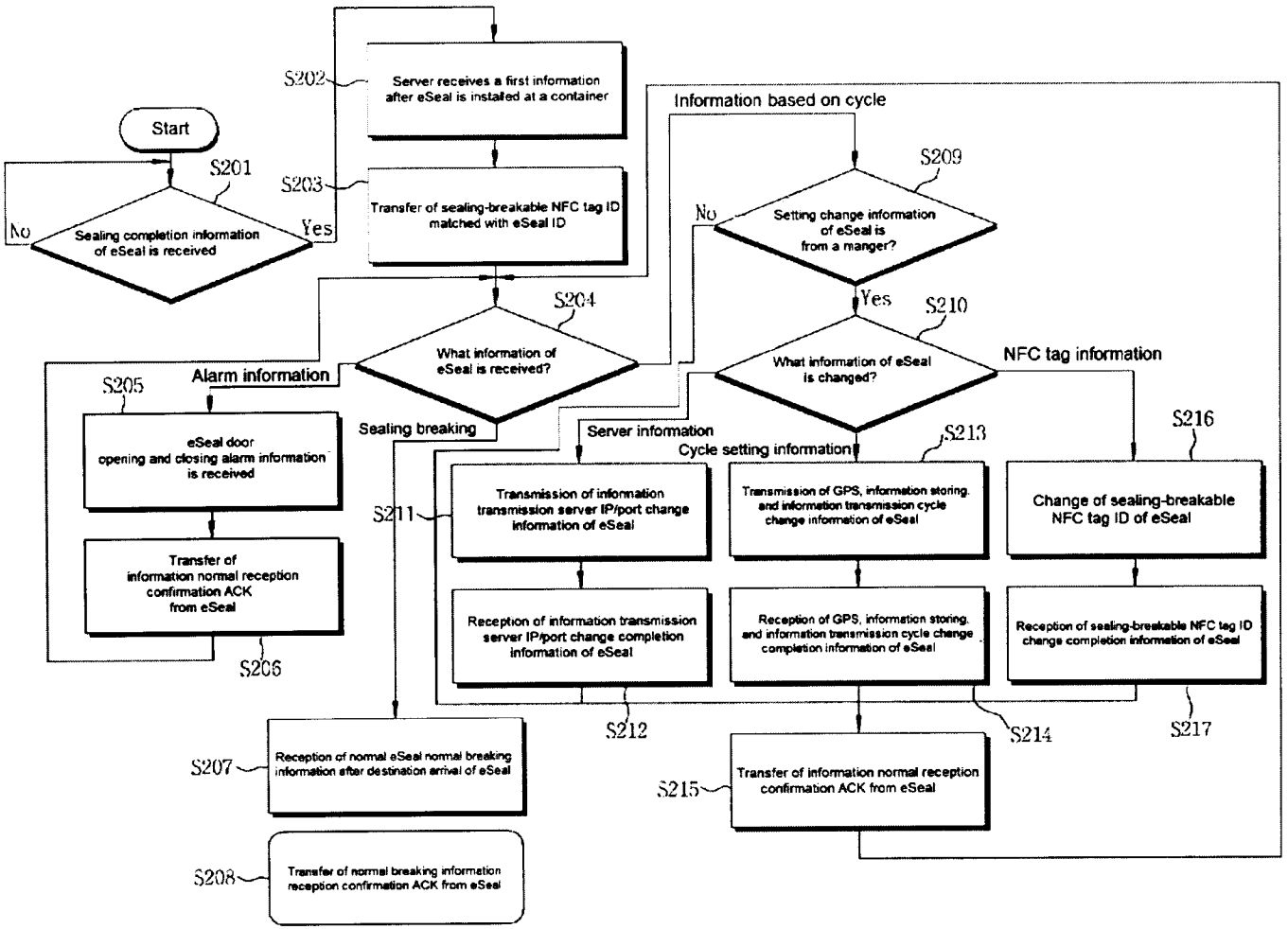

FIG. 6 is a flow chart for describing in detail at the side of the server the method which is able to operate the device for electronically sealing a container at the side of the server according to an embodiment of the present invention.

Referring to FIG. 6, first, the container electronic sealing device 100 is attached to a container, and the sealing is completed, a connection to the server 300 is made via a mobile communication network (S201). After that, when a request data (Init Packet) including a dedicated ID of the container electronic sealing device 100 is transmitted from the container electronic sealing device 100 (S202), the sealing-breakable NFC tag ID which is matching with the dedicated ID of the container electronic sealing device 100 is generated by the NFC tag pre-matching unit 340 and is transmitted to the container electronic sealing device 100 (S203).

When an information data (Data Packet) is received from the container electronic sealing device 100, it is checked what the received information data contains (a first check) (S204).

As a result of the first check (S204), the information data which has been received from the container electronic sealing device 100 is an alarm information, namely, an alarm information which was generated due to the breaking of the sealing of the container electronic sealing device 100, the received alarm information is checked, and the opening of the container door which corresponds to the container electronic sealing device 100 is reported via the manager and user terminal in the form of a SMS, an e-mail, etc. (S205).

An information response data is transferred, which may be used to check any normal reception of the information data received from the container electronic sealing device 100 (S206).

Moreover, as a result of the first check (S204), if the information data received from the container electronic sealing device 100 is a sealing breaking information, the current position information of the container electronic sealing device 100 and the NFC tag ID is detected among the received sealing breaking information, and it is checked if the container electronic sealing device 100 has arrived at the destination and the information is matched with the NFC tag ID (S207).

As a result of the check (S207), if the data corresponds to the normal sealing breaking information, an information response data is transferred, which is used to check the normal reception of the information data received from the container electronic sealing device 100 (S208).

Moreover, as a result of the first check (S204), if the information data received from the container electronic sealing device 100 is an information due to cycles, and if the set change information exists (S209), it is checked that what information of the container electronic sealing device 100 has been changed (a second check) (S210).

As a result of the second check (S210), if it is checked that the setting change information corresponds to the change of the server information, an information transmission sever IP and the port change information of the container electronic sealing device 100 are transmitted (S211), and a server IP and port change completion information are received from the container electronic sealing device 100 (S212).

Moreover, as a result of the second check (S210), if it is checked that the setting change information corresponds to the change of the cycle setting information, the GPS, the information storing, and the information transmission cycle change information of the container electronic sealing device 100 are transmitted (S213), and the GPS, the information storing, and the information transmission cycle change completion information are received from the container electronic sealing device 100 (S214).

In addition, as a result of the second check (S210), if it is checked that the setting change information corresponds to the change of the NFC tag information, the sealing-breakable NFC tag ID change (an addition and a deletion) information of the container electronic sealing device 100 is transmitted (S216), and a sealing-breakable NFC tag ID change completion information is received from the container electronic sealing device 100 (S217).

If a change completion information is received as a result of the second check (S210), the information normal reception check response data from the container electronic sealing device 100 is transferred to the container electronic sealing device 100 (S215).

The manager is able to set, from the remote distance, the information transmission cycle, the server IP/port change and the sealing breaking authorization remote setting during the operation of the container electronic sealing device, and the equipment security can be enhanced by immediately cancelling the tag if the sealing-breakable authorization NFC tag is lost or robbed.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A container sealing device for electronically sealing a container using proximity wireless communication, comprising:

a main body unit detachably installed at a container door, the main body unit including a driving control unit disposed inside the main body unit, at least one guide hole and a locking hole formed in a top of the main body unit, and a drainage hole formed in a lateral side of the main body unit and communicating with the guide hole and the locking hole such that water which flows into an inside of the guide hole and the locking hole is directly discharge to an outside of the main body unit; and a locking unit configured to lock and unlock the container door in accordance with a control signal from the driving control unit and configured to be slidingly inserted into said at least one guide hole, the locking unit including a locking bar configured to be slidingly inserted into the locking hole to lock and unlock the container door, wherein the driving control unit comprises:

a mobile communication unit which is configured to communication with a server located outside;

a GPS (Global Positioning System) which is provided to locate a current position of the container sealing device;

a storing unit which is configured to store an internal information of the container and an ID (Identification) of a NFC (Near Field Communication) tag;

a sealing detection sensor unit which is configured to check if the container door has been illegally opened;

a NFC unit which is provided to control a sealing by unlocking the container door by employing a NFC (Near Field Communication) method; and a setting processing unit which is provided to transmit transmission data to the server or a user terminal at a cycle set by a user, wherein the transmit transmission data includes a state of the sealing and GPS information checked by the sealing detection sensor unit, and if an illegal opening and closing and a deviation from a set path occur, event data is transmitted in real time to the server or the user terminal.

2. The container sealing device of claim 1, wherein the driving control unit further comprises a container internal and external detection sensor unit which is provided to sense surrounding information, the surrounding information including at least one of a temperature, a humidity, a position, a sealing, an impact, and a luminance inside and outside of the container door.

3. The container sealing device of claim 1, wherein the ID of the NFC tag is used to break the sealing of the container door wherein when the driving control unit transmits an ID of the container sealing device to the server via the mobile communication unit, the server transmits the ID of the NFC tag corresponding to the ID of the container sealing device.

4. The container sealing device of claim 1, wherein the storing unit is configured to store information requested to the server, sealing breaking information, a log on information transmitted to user, and an equipment state log.

5. A system for operating a device for electronically sealing a container, comprising:

the container sealing device of claim 1; and a server which is configured to transmit or receive data, wherein the server includes:

an information transmission and receiving interface unit which is configured to transmit and receive information with the container sealing device;

an information encoding and decoding unit which is configured to encode and decode data with respect to the container sealing device via the information transmission and receiving interface unit;

an information analyzing unit which is configured to analyze a content of the information data received via the information transmission and receiving interface unit;

a NFC tag pre-matching unit which is provided to generate the ID of the NFC tag used to break the sealing of the container sealing device based on an ID of the container sealing device received from the container sealing device and check the matching state of the ID of the NFC tag received from the container sealing device when the container sealing device arrives at a destination;

a transfer information packet generation unit which is configured to generate a packet of the data which is transmitted to the container sealing device;

a state setting unit which is configured to set the sealing state of the container sealing device based on a data transmission and reception with the container sealing device; and a manager interface unit which is configured to transmit or receive a setting change and a setting change completion information by a manager based on the state setting unit.

6. The system of claim 5, wherein the NFC tag pre-matching unit generates multiple IDs of the NFC tag.

7. A method for electronically sealing a container using proximity wireless communication, comprising:

sealing, by a driving control unit, a container sealing device detachably installed in a container;

requesting, by the driving control unit, initialization data to an external server via a mobile communication network, the initialization data including an ID of the container sealing device previously set therein;

transmitting, by the external server, initialization acknowledge data to the driving control unit, the initialization acknowledge data including an NFC tag ID corresponding to the ID of the container sealing device, a data storing cycle, and a data transmission cycle, wherein the NFC tag ID is used to break said sealing of the container sealing device;

receiving, by the driving control unit, the initialization acknowledge data from the external server, and storing, by the driving control unit, the initialization acknowledge data in a memory thereof;

storing, by the driving control unit, information data in the memory of the driving control unit at the data storing cycle, and transmitting the information data to the external server using the mobile communication network at the data transmission cycle, the information data including surrounding information obtained by detecting an inside and outside of the container door;

transmitting, by the external server, information acknowledge data to acknowledge receiving the information data and command data to the driving control unit;

performing, by the driving control unit, commands corresponding to the command data received from the external server, and transmitting command acknowledge data to the external server;

breaking, by the driving control unit, said sealing of the container sealing device using the NFC tag ID, when the container arrives at a destination; and when said sealing of the container sealing device is broken, rebooting the container sealing device.

8. The method of claim 7, wherein the command data includes commands to change a server IP and port, the data storing cycle, and the data transmission cycle and to add and delete the NFC tag ID.

9. The method of claim 7, wherein the surrounding information includes a temperature, a humidity, a position, a sealing, an impact, and a luminance, and the driving control unit transmits the surrounding information to the external server or a user terminal when the surrounding information is out of a previously set threshold value.

10. The method of claim 7, wherein the driving control unit receives an expected movement path of the container from the external server, and if the container is out of the expected movement path or if an illegal opening of a door of the container occurs, the driving control unit transmits an alarm in real time to the external server or the user terminal.

11. The method of claim 7, wherein if no NFC tag ID exists in the container sealing device, the driving control unit is configured to break said sealing of the container sealing device at a region predetermined by a GPS value.

12. The method of claim 7, wherein if the container does not arrive at the destination within a predetermined time, the driving control unit transmits an alarm the external server or the user terminal.

13. The method of claim 7, wherein the driving control unit further stores sealing breaking information, a log on communications between the driving control unit and the external user and the user terminal, and an equipment state log.

14. A method for operating a device for electronically sealing a container, comprising:

requesting, by a container sealing device, initialization data to a server via a mobile communication network, the initialization data including an ID of the container sealing device previously set therein;

transmitting, by the server, initialization acknowledge data to the container sealing device, the initialization acknowledge data including a data storing cycle, a data transmission cycle and an NFC tag ID corresponding to the ID of the container sealing device, wherein the NFC tag ID is used to break a sealing of the container sealing device;

storing, by the container sealing device, the initialization acknowledge data in a memory of the driving control unit, and transmitting, by the container sealing device, information data including surrounding information sensed by the container sealing device using the mobile communication network at the data transmission cycle;

transmitting, by the server, information acknowledge data to acknowledge a reception of the information data or command data to the container sealing device, the command data including commands to change a server IP/port, the data storing change, and the data transmission cycle and to add and delete the NFC tag ID;

performing, by the container sealing device, the commands corresponding to the command data and transmitting command acknowledge data, to the server;

receiving, by the container sealing device, an expected movement path from the server, and transmitting an alarm to the server if the container sealing device is deviated from the expected movement path;

when the container sealing device arrives at a destination and receives an NFC tag to break the sealing of the container sealing device, checking whether the NFC tag matches the NFC tag ID stored in the memory, and transmitting breaking setting information to the server; and breaking, by the container sealing device, the sealing of the container sealing device using the NFC tag, and rebooting the container sealing device when the sealing of the container sealing device is broken.

15. A method for operating a device for electronically sealing a container, comprising:

receiving, by a server, initialization data from a container sealing device connected via a mobile communication network, and transmitting an NFC tag ID previously matched with an ID of the container sealing device to the container sealing device;

receiving, by the server, information data from the container sealing device, and checking the information data;

if the information data received from the container sealing device includes an alarm information, sending an SMS or e-mail to a manager and a user terminal to report that a container door is open;

if the information data received from the container sealing device includes sealing breaking information, checking if current position information and an NFC tag of the container sealing device among the sealing breaking information match a destination and the NFC tag ID, respectively;

if the information data received from the container sealing device includes setting change information corresponds to a change of a server information, transmitting changed IP and port information of the container sealing device to the container sealing device;

if the information data received from the container sealing device includes the setting change information corresponds to a change of a cycle setting information, transmitting changed cycle of a GPS, an information storing, and an information transmission to the container sealing device; and if the information data received from the container sealing device includes the setting change information corresponds to a change of the NFC tag information, transmitting a changed NFC tag ID to the container sealing device.

16. The method of claim 15, further comprising:

when checking the information data has been completed, transmitting information response data to the container sealing device to acknowledge a safe reception of the information data.

17. The method of claim 15, further comprising:

after transmitting said changed information to the container sealing device, receiving change completion information corresponding to the setting change information from the container sealing device.

* * * * *